US009163340B2

(12) United States Patent
Vahhabaghai et al.

(10) Patent No.: US 9,163,340 B2
(45) Date of Patent: Oct. 20, 2015

(54) METHOD OF FABRICATION OF A WEAVE OF MATERIAL STRIPS WITHIN A METAL MESH

(71) Applicants: Rouzita Vahhabaghai, Washington, DC (US); Bita Vahhabaghai, Washington, DC (US)

(72) Inventors: Rouzita Vahhabaghai, Washington, DC (US); Bita Vahhabaghai, Washington, DC (US)

( * ) Notice: Subject to any disclaimer, the term of this patent is extended or adjusted under 35 U.S.C. 154(b) by 272 days.

(21) Appl. No.: 13/800,111

(22) Filed: Mar. 13, 2013

(65) Prior Publication Data

US 2014/0090740 A1 Apr. 3, 2014

Related U.S. Application Data

(60) Provisional application No. 61/610,166, filed on Mar. 13, 2012.

(51) Int. Cl.

| | |
|---|---|
| ***D03D 15/02*** | (2006.01) |
| ***D03D 9/00*** | (2006.01) |
| *D03D 15/00* | (2006.01) |
| *D04H 13/00* | (2006.01) |

(52) U.S. Cl.

CPC ..... *D03D 15/02* (2013.01); *D03D 9/00* (2013.01); *D03D 15/00* (2013.01); *D03D 15/005* (2013.01); *D04H 13/007* (2013.01); *D10B 2401/062* (2013.01); *D10B 2403/02411* (2013.01); *Y10T 29/49886* (2015.01); *Y10T 29/49888* (2015.01); *Y10T 29/49968* (2015.01)

(58) Field of Classification Search

CPC ..... D03D 15/02; D03D 9/00; D03D 15/005; D03D 15/006; D03D 15/00; D10B 2403/02411; D10B 2401/062; D04H 13/007; D19B 2101/20; Y10T 29/49885; Y10T 29/49888; Y10T 29/49968

See application file for complete search history.

(56) References Cited

U.S. PATENT DOCUMENTS

| | | | | | |
|---|---|---|---|---|---|
| 2,141,706 | A | * | 12/1938 | Buchanan | 245/10 |
| 2,144,689 | A | * | 1/1939 | Roberts | 112/413 |
| 3,346,465 | A | * | 10/1967 | Franck | 205/122 |
| 2006/0213234 | A1 | * | 9/2006 | Gladfelter et al. | 66/190 |

* cited by examiner

*Primary Examiner* — John C Hong

(74) *Attorney, Agent, or Firm* — Sofer & Haroun, LLP

(57) ABSTRACT

A method is provided for making a weave of material strips within a metal mesh. The method includes providing a metal mesh having a plurality of rows of rods linked together by a plurality of columns of malleable cables woven through the rods. A plurality of openings are formed as slots enclosed between two rods opposite one another and two cables opposite one another. Strips of material are inserted into the openings in the metal mesh and the strips are interlaced through the openings to create a woven appearance.

8 Claims, 14 Drawing Sheets

METHOD OF FABRICATION OF A WEAVE OF MATERIAL STRIPS WITHIN A METAL MESH

RELATED APPLICATION

This application claims the benefit of priority from U.S. Provisional Patent Application No. 61/610,166, filed on Mar. 13, 2012, the entirety of which is incorporated by reference.

BACKGROUND

1. Field of the Invention

The present arrangement relates to a material, and method of fabrication of the same, applied to articles for aesthetic purposes, such as handbags, jewelry, interior home design etc. . . . . More particularly the material includes leather strips within a metal mesh.

2. Description of Related Art

Architectural design materials can include, among other materials, metal meshes which can typically be used in the architectural industry in such areas as exterior panel systems, solar screens, interior design for panels, room dividers, and elevator panels.

OBJECTS AND SUMMARY

The present arrangement, using such architectural metal meshes as a base, uses such meshes with interwoven fabrics, such as leather fabrics, in order to create a weave for application to fashion and home accessories. Such weaves of leather strips within a metal mesh may be advantageously applied to articles for aesthetic purposes, such as handbags, jewelry, interior home design etc. . . . .

To this end, the method includes the steps of providing a metal mesh comprising a plurality of rows of rods linked together by a plurality of columns of malleable cables woven through the rods, wherein a plurality of openings are formed as slots enclosed between two rods opposite one another and two cables opposite one another. Strips of material are inserted into the openings in the metal mesh and the strips are interlaced through the openings to create a woven article.

DETAILED DESCRIPTION

Figure 1:
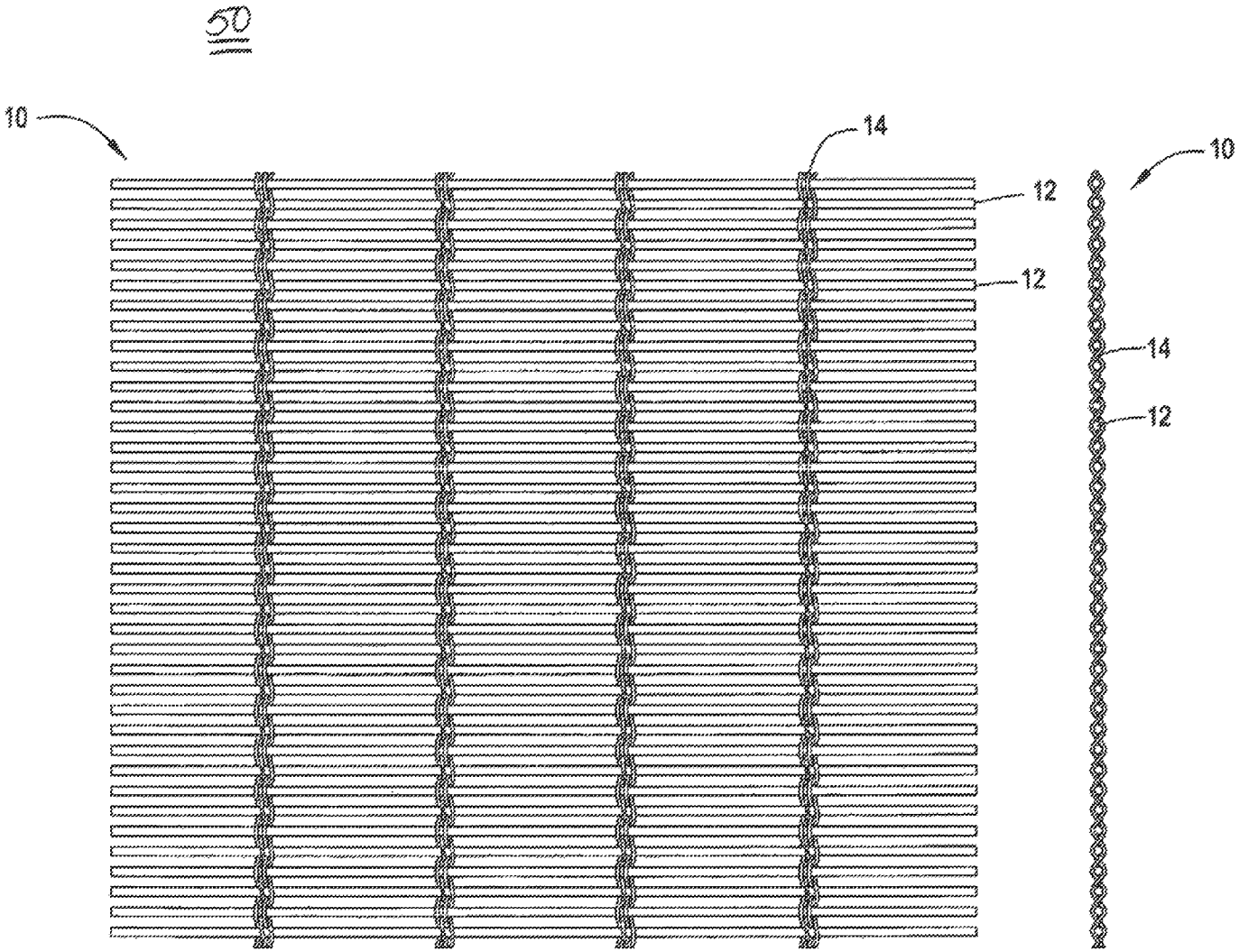
FIG. 1 is a planar view of the metal mesh according to one embodiment.
Figure 2:
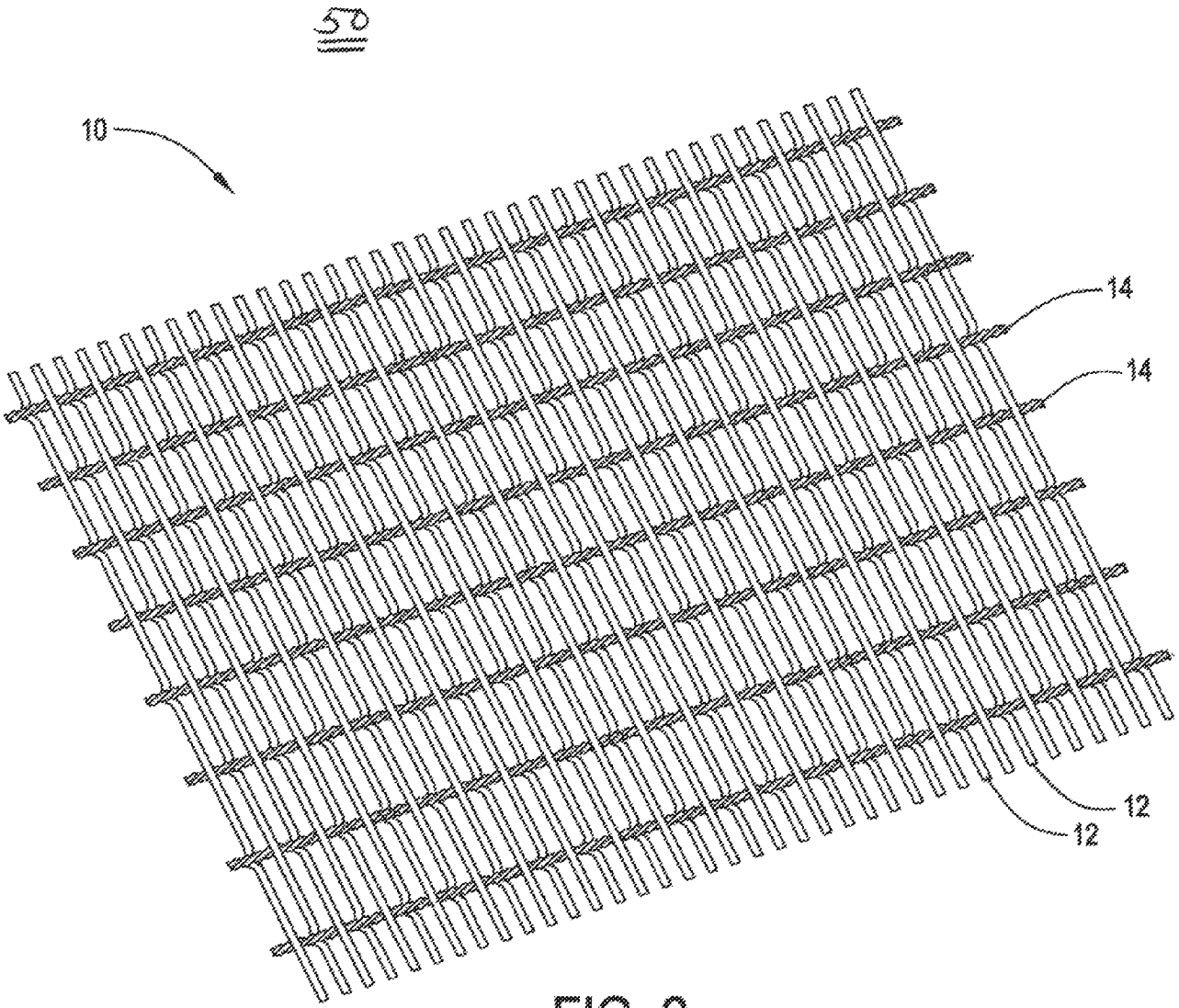
FIG. 2 is a perspective view of the metal mesh according to one embodiment.
Figure 3:
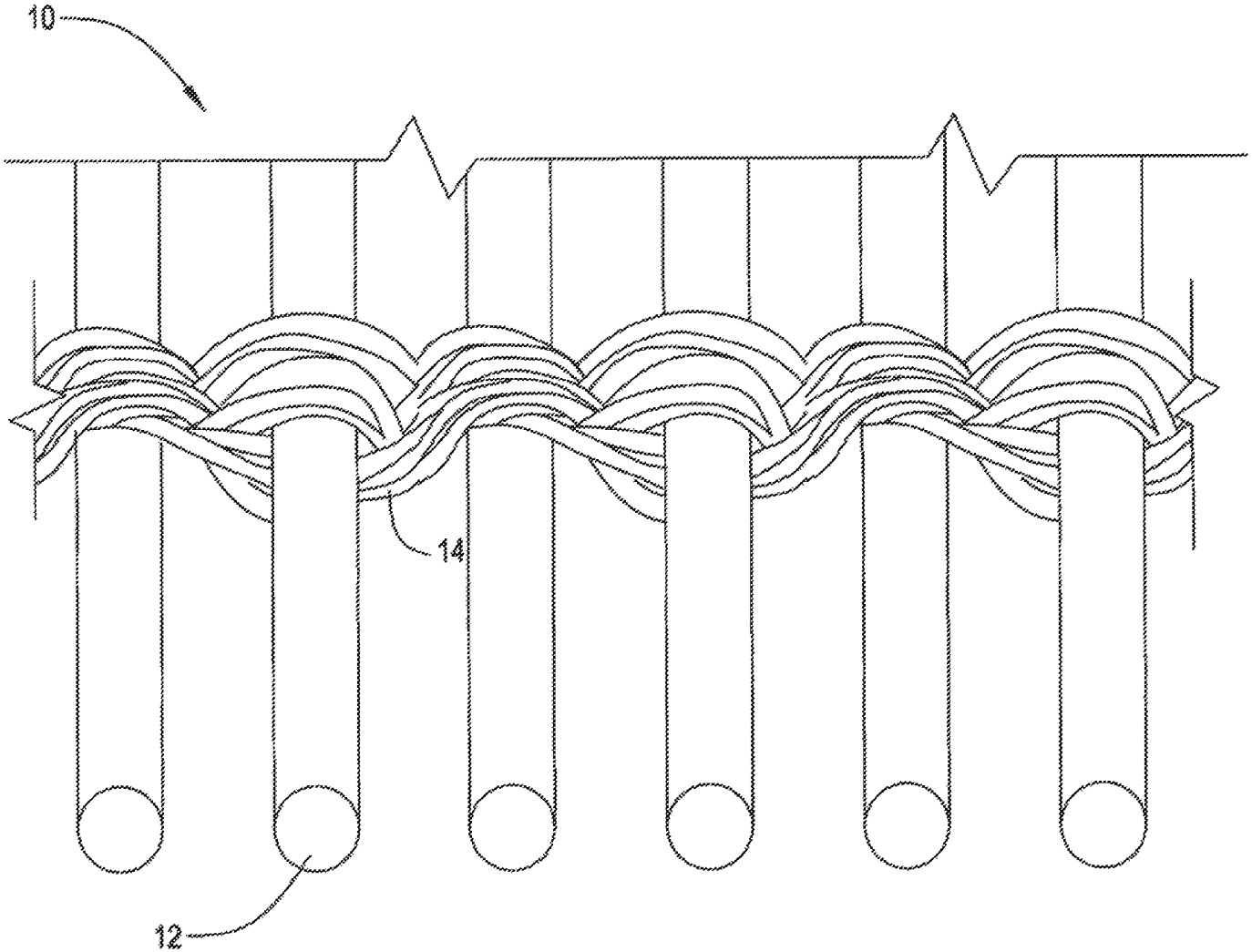
FIG. 3 is a close-up view of the rods and a cable of the metal mesh according to one embodiment.
Figure 4:
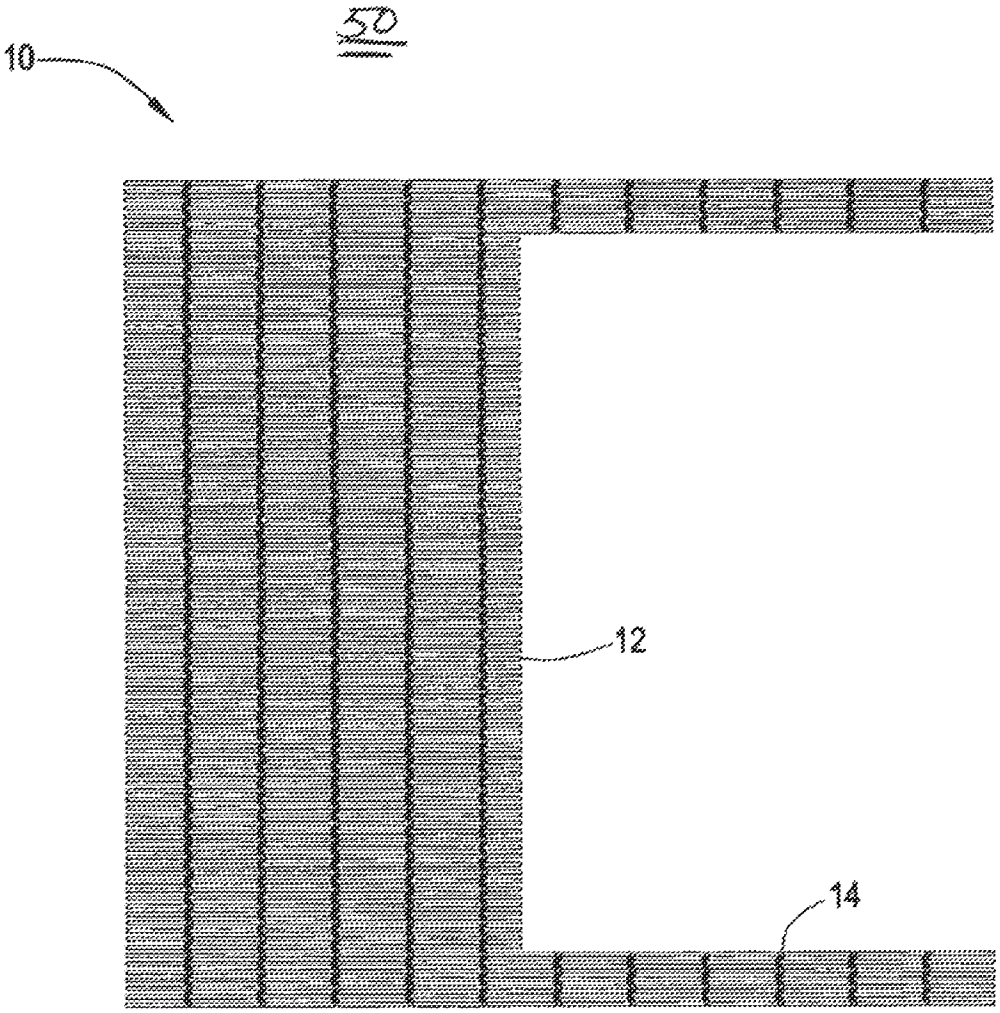
FIG. 4 is a planar view of the cut mesh according to another embodiment.
Figure 5:
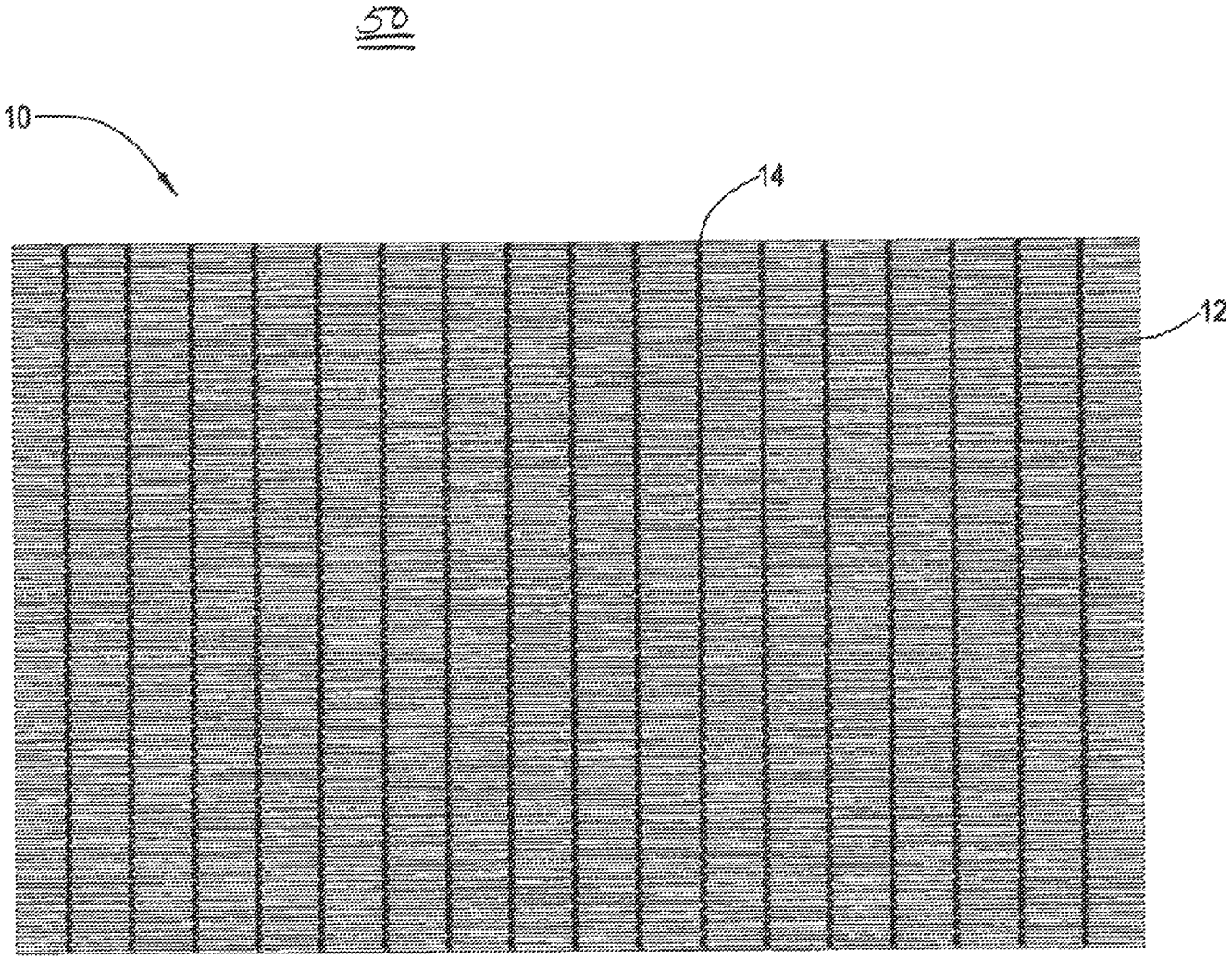
FIG. 5 is a planar view of the cut mesh according to another embodiment.
Figure 6:
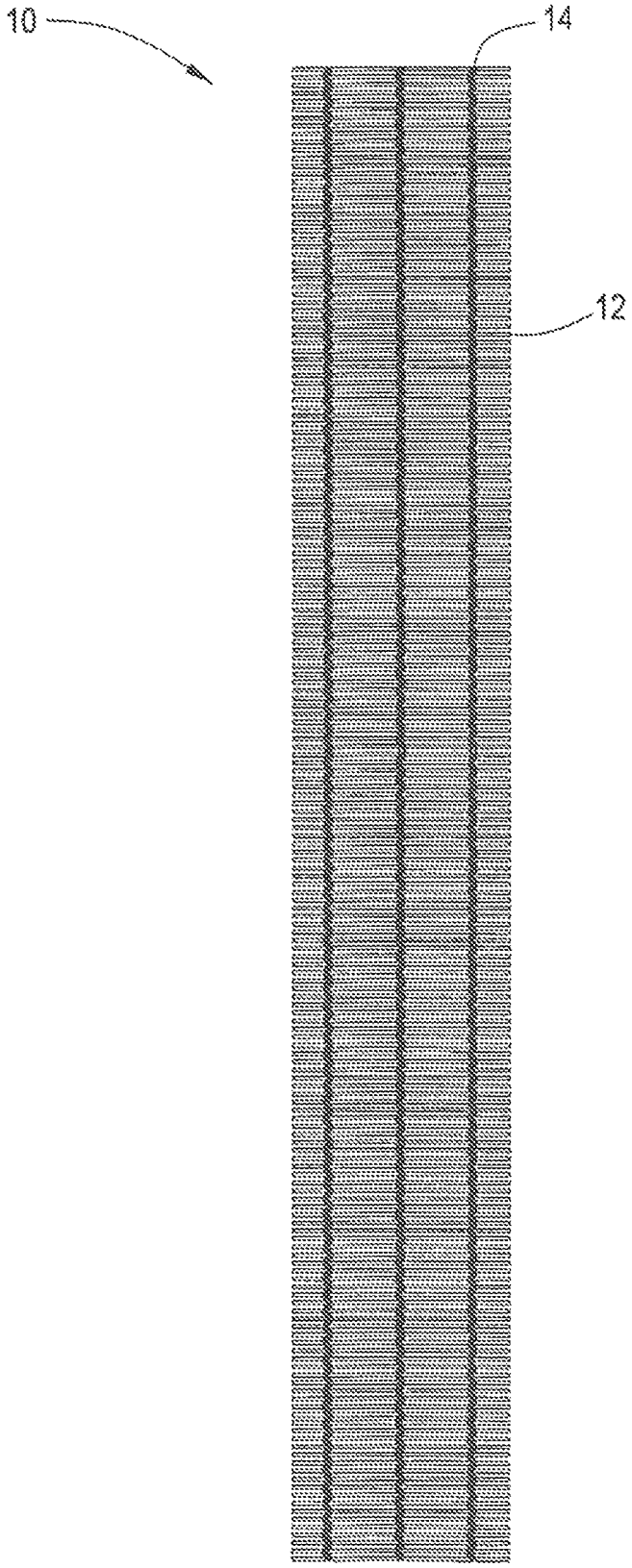
FIG. 6 is a planar view of the cut mesh according to another embodiment.
Figure 7:
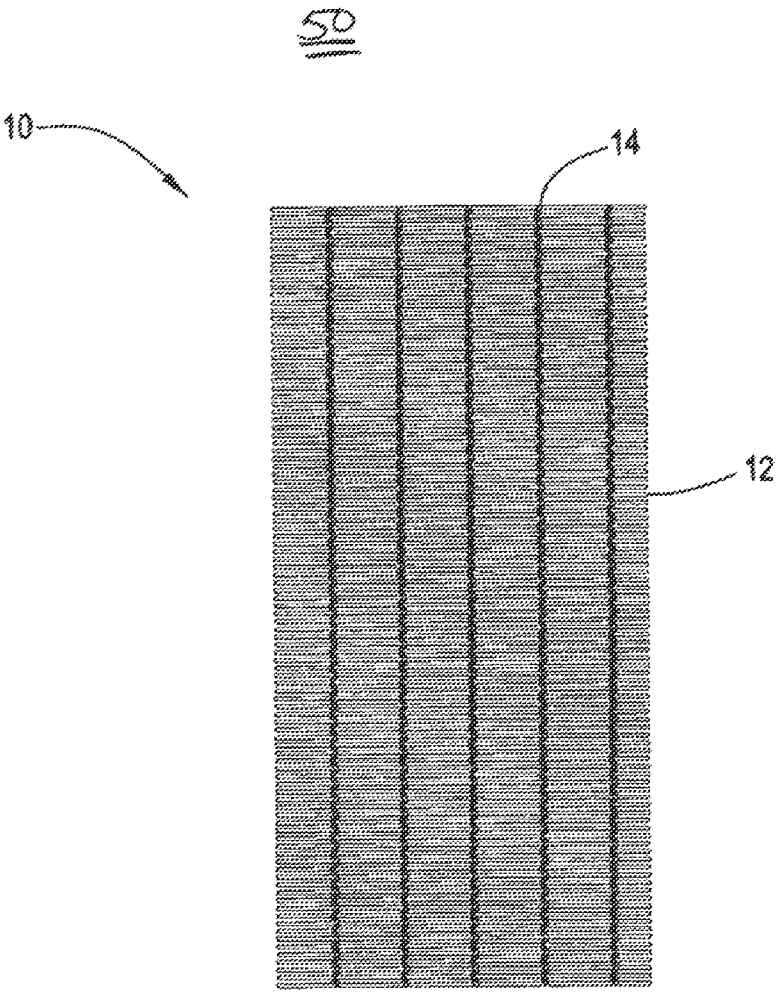
FIG. 7 is a planar view of the cut mesh according to another embodiment.

Reference is made to FIGS. 1-3 which illustrate a metal mesh material 10 used as the base material in the weave of the present application. The components of metal mesh 50 are typically made of stainless steel however any metal can be used. There are a number of manufacturers of metal mesh material 10 and multiple suppliers, for example GKD Metals™ and Cambridge Architectural Metals™ which carry many sizes and shapes of metal mesh 50.

Metal mesh 50 is formed by a number of rows of solid cylindrical rods 12 which are linked together by a number of perpendicularly arranged and spaced apart columns of malleable cables 14, woven through the rods in a criss-cross manner.

One type of mesh 50 as depicted in FIG. 1, has the plurality of cables 14 twisted into multiple smaller bundles which are interwoven through rods 12 in an alternating pattern whereby one bundle is woven over a first rod 12 while a second bundle is woven under the next adjacent rod 12. As seen on the side of FIG. 1, mesh 50 as illustrated in FIG. 1 is flat on both its top and bottom sides. FIG. 3 is a close up side illustration of FIG. 1.

An alternative mesh 50 is depicted in FIG. 2, and also has a plurality of perpendicularly arranged and spaced apart cables 14 twisted together into one bundle which is interwoven through rods 12. Mesh 50 as illustrated in FIG. 2 has a flat top side and a ridged bottom side where rods 12 are dented to accommodate the weaving cables 14. In alternative embodiments (not shown), mesh 50 may be made from rods 12 in both directions or cables 14 in both directions.

In the above embodiments, rods 12 are generally 1/16" apart from one another and cables 14 are approximately 7/8-1" apart from one another. Metal mesh material 10 is typically sold as sheets. Mesh 50 can then be further cut into various sizes and shapes as illustrated by FIGS. 4-7.

Metal mesh 50 can be plated with gold, silver, rhodium, gun metal or the like for aesthetic purposes. Metal mesh 50 is cleaned first prior to plating. Cables 14 of metal mesh 50, after use and wear and tear, can shift and unfasten from rods 12 as the normal use of such meshes is architectural and not for regular use as a personal article where flexing can occur frequently. The plating process secures cables 14 relative to rods 12 so that they do not shift or get loose. It is preferable that the plating process include a sufficient activation time in order to have a stronger bond for the plating and to minimize chipping.

In an alternative embodiment, metal mesh 50 can be cast in brass as a form with lines created in the form to mimic the look of cables 14. In some arrangements, brass is easier to work with than stainless steel and retains the plating better than stainless steel.

Metal mesh 50 is bendable in one direction due to the malleability of cables 14. Due to the malleable nature of cables 14, metal mesh 50 can be bent and formed in order to be incorporated into an article for decorative purposes.

Figure 9:
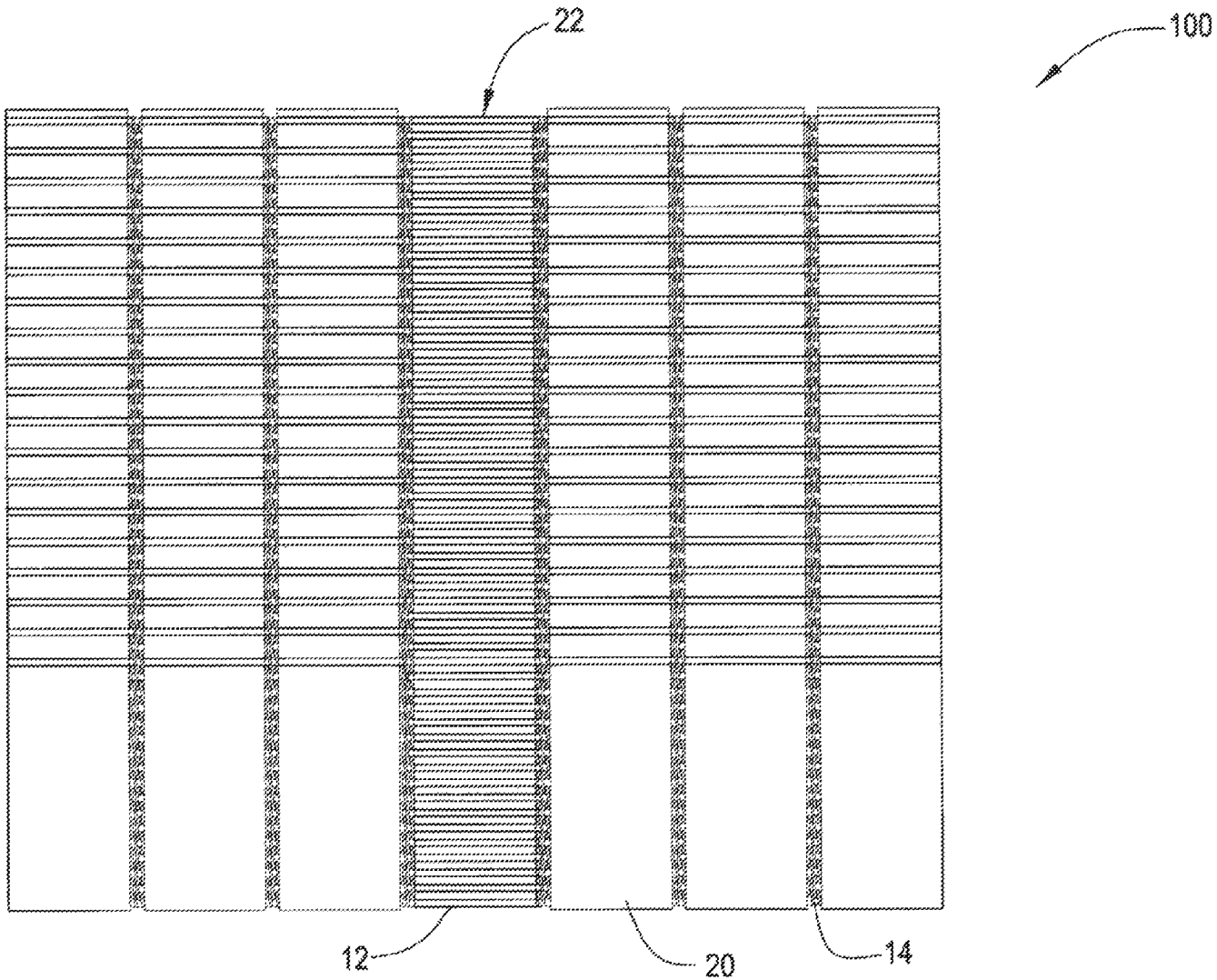
FIG. 9 is a planar view of the present invention as applied to a handbag according to one embodiment.
Figure 10:
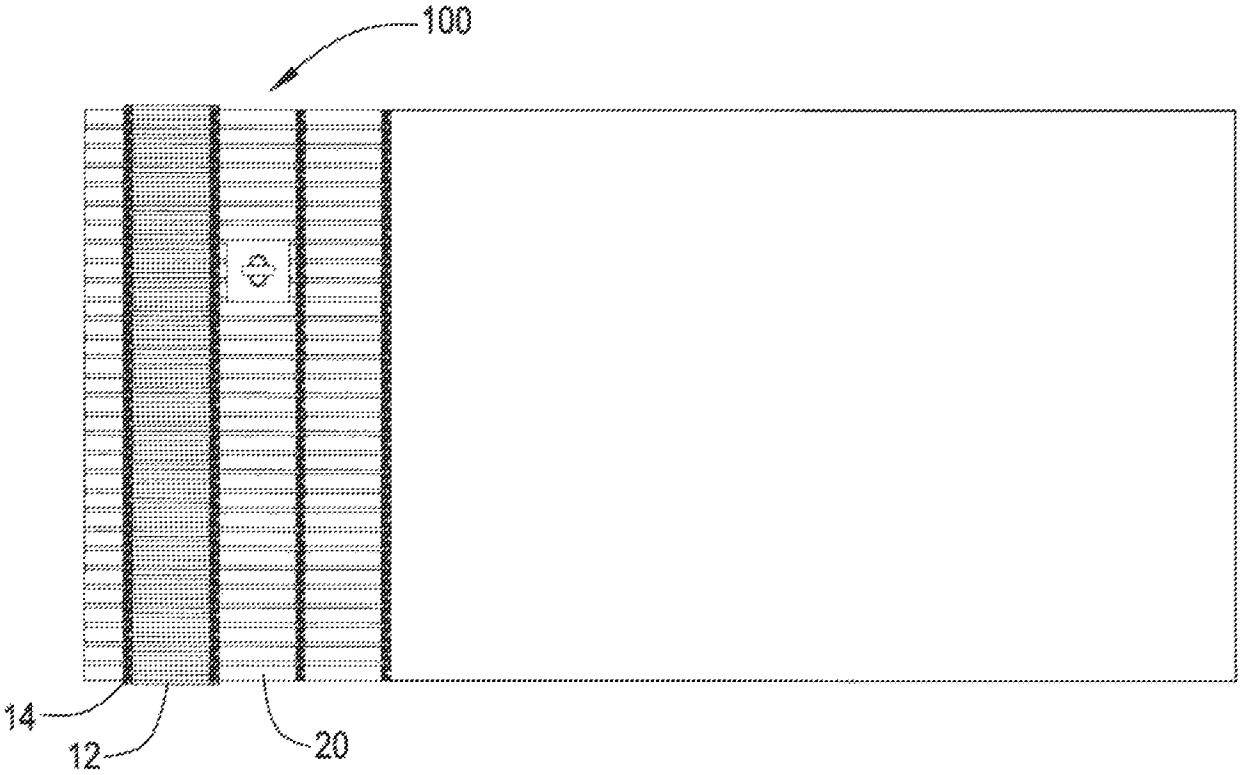
FIG. 10 is a planar view of the present invention as applied to a handbag according to another embodiment.
Figure 11:
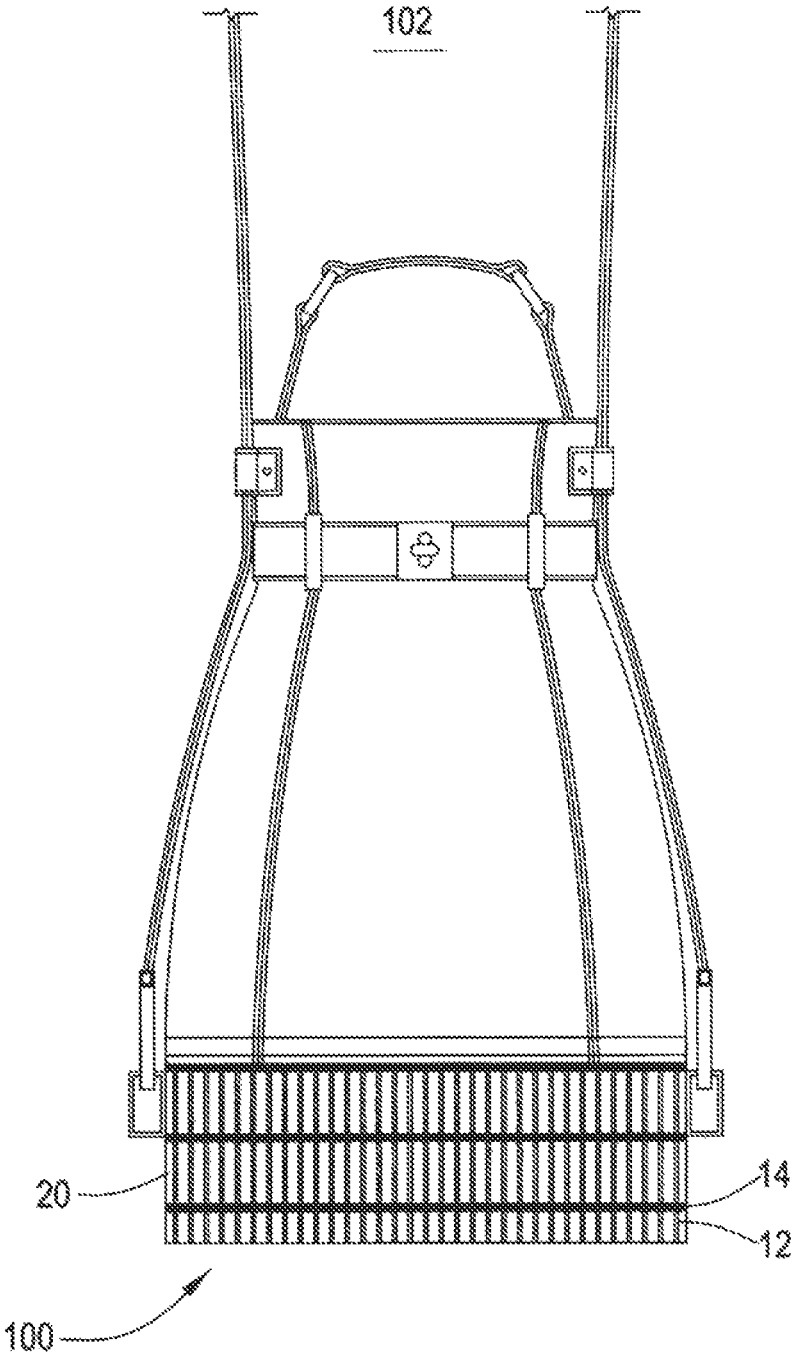
FIG. 11 is a planar view of the present invention as applied to a handbag according to another embodiment.
Figure 12:
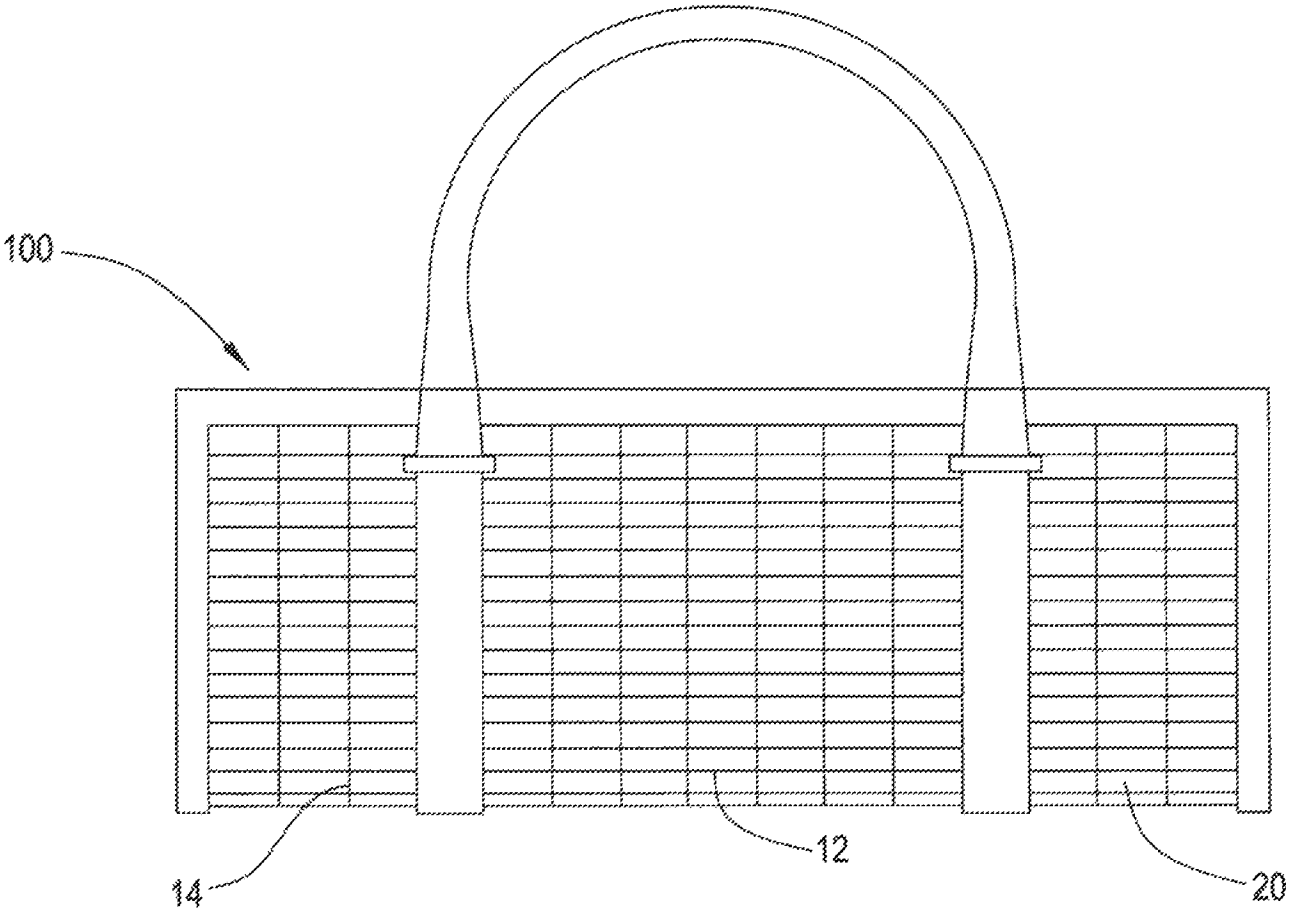
FIG. 12 is a planar view of the present invention as applied to a handbag according to another embodiment.

In certain alternative arrangements, as illustrated in FIGS. 9 and 12 described in more detail below, when metal mesh 50 forms the entire makeup of an article as opposed to just an embellishment to an article, then mesh 50 must be formed to the shape of the article prior to plating and then plated with the metal of choice. One reason for shaping the metal to the form of the article prior to plating it is to prevent the plating on the cables from peeling off during the bending and shaping process. This is done for aesthetic purposes and to maintain the plating consistency throughout.

When cables 14 forming mesh 50 are cut down to an intended size, the ends of the cables can be very sharp. These ends of cables 14 may be soldered if they are not otherwise capped with leather as explained in more detail below, so that if they are exposed, they are not sharp.

Figure 8:
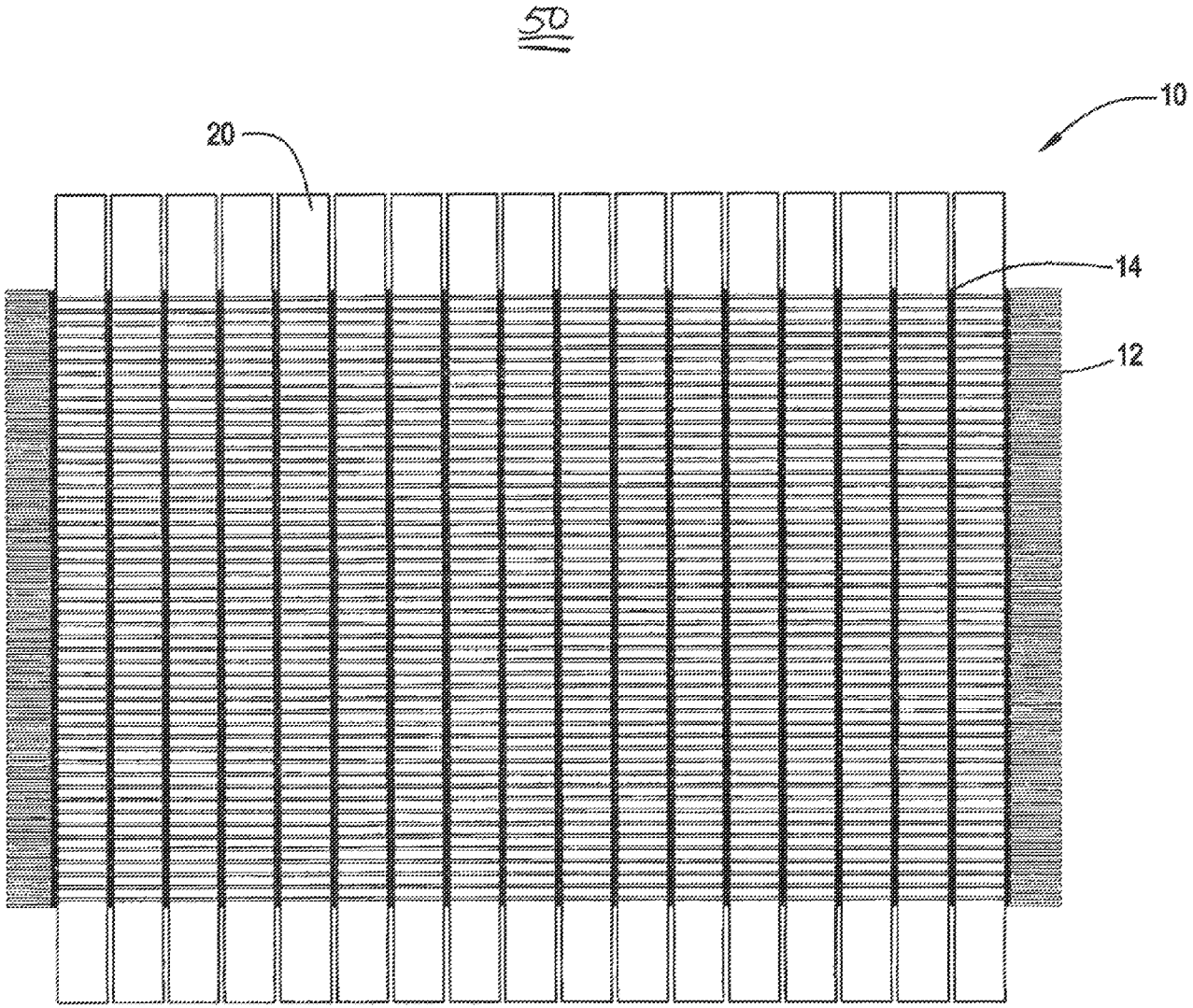
FIG. 8 is a planar view of the weave according to one embodiment.

Once the plating is complete and mesh 50 is of the appropriate size for the intended article, leather strips may be woven through the openings between rods 12 and cables 14 as shown in FIG. 8, The openings enclosed by two rods 12 opposite one another and two cables 14 opposite one another form slots in which material can be inserted and woven into metal mesh material 10. Any type of material or fabric can be used, but for the purposes of illustration, the present arrangement contemplates the use of leather strips.

In a preferred embodiment, leather is cut into strips 20 in the thickness of approximately 1/16" corresponding to the gap between adjacent rods 12. Leather strips 20 fit within the slots of mesh material 10 and are interlaced through mesh 50 via an in-out alternating weave in order to create a woven appearance. This creates a tight bond between the two materials. If the leather is too thick to weave, the leather may be skived down to an appropriate thickness. Leather strips 20 woven through the end rows of mesh 50 provide protection from having sharp edges on the ends of weave 100. As long as leather strips 20 align with the end rows of mesh 50, there are no sharp edges.

In one embodiment, as shown in FIG. 8 leather strips 20 are cut slightly longer than metal mesh 50 at both ends so that when strips 20 are woven into mesh 50 there is extra leather which extends beyond mesh 50 on both ends. In some cases, the ends of leather strips 20 are applied directly over the edge of metal mesh 50. In another embodiment, leather strips 20 may cover the sharp edges of rods 12 or cables 14.

Figure 13:
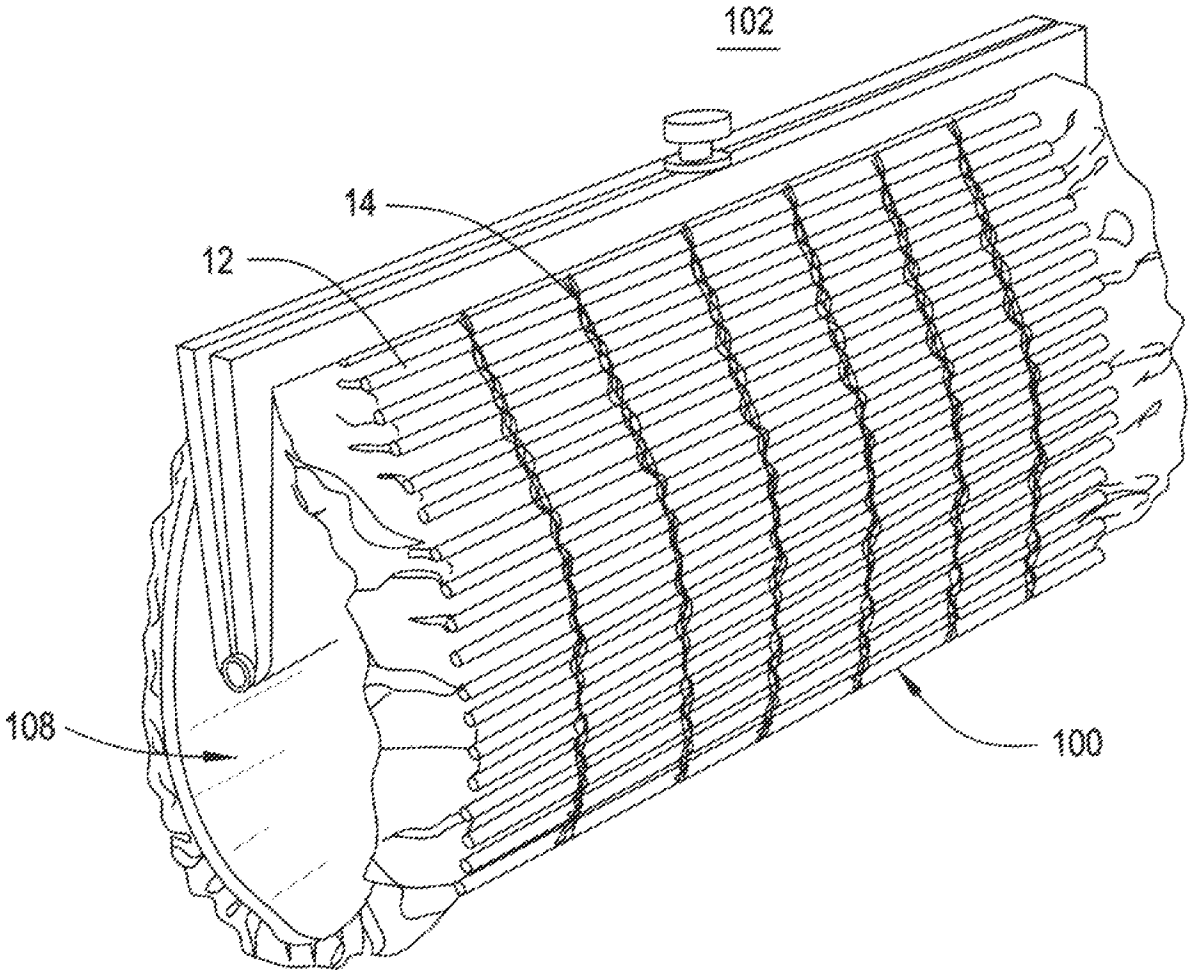
FIG. 13 is a perspective view of the present invention as applied to a handbag according to another embodiment.

In a further embodiment, as illustrated in FIG. 13, weave 100 does not end in strips, rather the leather extends beyond the last weave and then connects to gusset 108.

Once leather strips 20 are woven through the piece of metal mesh 50, the metal-leather weave 100 can then be applied to various items or used in the construction of various items in order to enhance the décor as illustrated by FIGS. 9-12. Such items include but are not limited to handbags, wallets, luggage, travel and PDA accessories, jewelry, apparel, footwear, fashion accessories, home furnishings, lighting, home accessories etc. Weave 100 can also be used to hold and contain articles, for example when an entire handbag is made up of weave 100.

In another embodiment, as depicted partially in FIG. 9, leather strips 22 are adhered to the back portion of mesh 50 as opposed to being woven through the slots between rods 12 and cables 14. Leather strip 22 is visible through the slots and this creates a different look as well as a different texture.

Once weave 100 is completed as outlined above, a completed weave 100 segment may be incorporated into a larger product such as forming a portion of a handbag, by stitching either leather or a lining to weave 100 using a sewing machine and/or a special fabric glue depending on the point of attachment.

Figure 14:
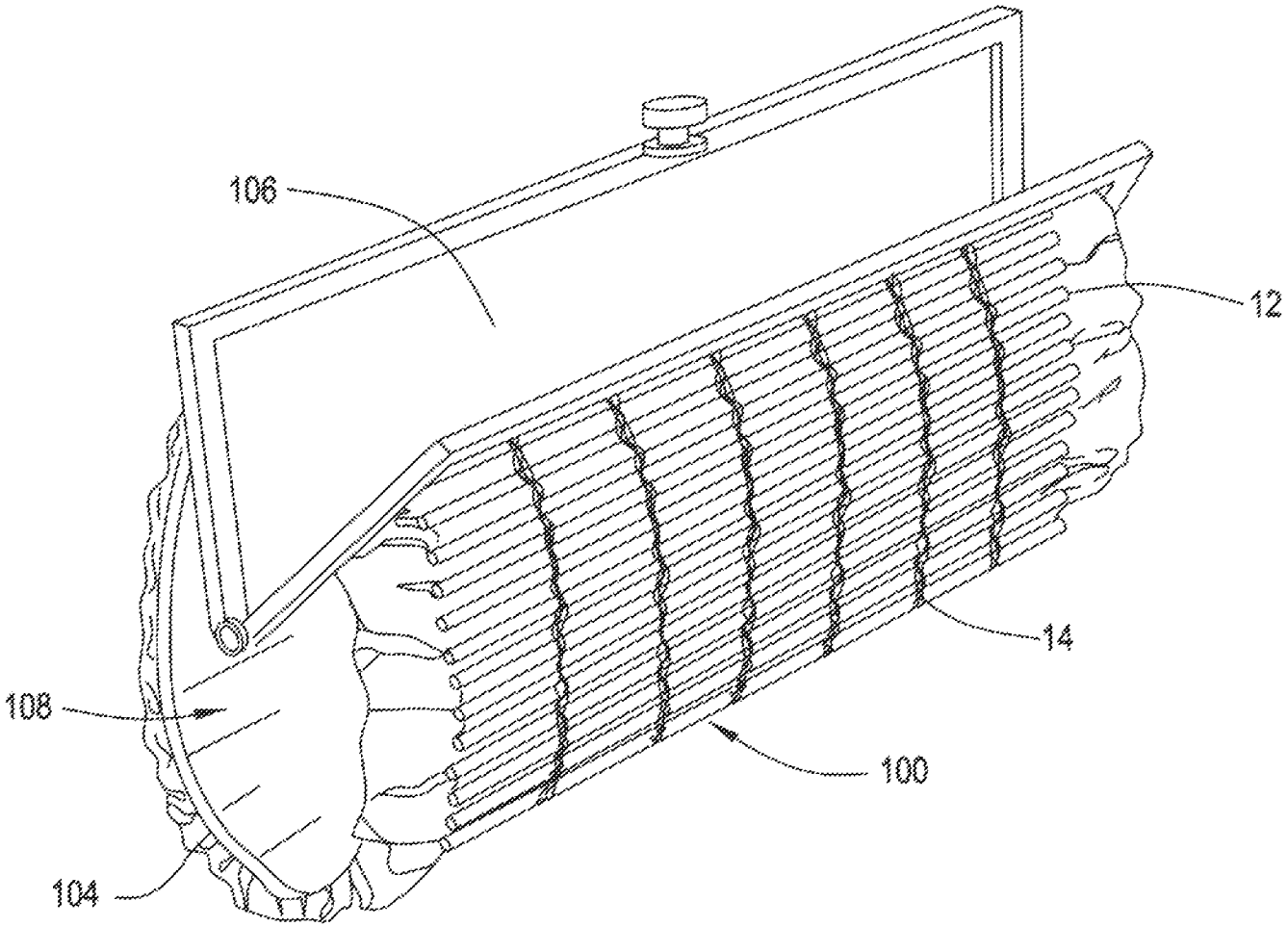
FIG. 14 is a perspective view of the present invention as applied to a handbag in an opened position according to another embodiment.

For example, as shown in FIG. 14 when weave 100 is incorporated into a handbag 102, for ends of the bag 104 that run parallel to cables 14, leather strips 20 are extended beyond mesh 10 and folded over and glued to the other side of mesh 10 to create a closed and finished leather edge. The lining and/or inside leather flaps are attached to inside of the bag 106 with glue in order to cover the extended leather pieces and keep them in place. For bag gussets 108, the leather/lining is stitched directly to weave 100 parallel to ends of the bags 104 as the final step to hold the shape of bag 102 (i.e. round, curved, perpendicular corners etc.). In bucket bags, such as that shown in FIG. 11, hardware such as latches can be included into weave 100, for example by sewing, tying, screwing or other connection means to the underlying mesh 10, in order to hold the straps, so that weave 100 also helps support the hardware that connects to straps that hold the weight of bag 102. The hardware can also be connected to weave 100 directly so that weave 100 holds the actual hardware. Weave 100 can also be a continuous circular shape with the leather connecting and weaving back to the first point of mesh 10 in order to close the circle.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

We claim:

1. A method for making a weave of material strips within a metal mesh, the method comprising the steps of:

obtaining a metal mesh made from a plurality of rows of stiff cylindrical rods linked together by a plurality of columns of malleable cables woven through each successive rod, said mesh having a plurality of slots each formed by two adjacent rods and two adjacent cables, said metal mesh being constructed as bendable in one direction; and inserting strips of material into said slots in said bendable metal mesh and interlacing said strips through each successive adjacent slot to create a combined material and metal mesh weave.

2. The method of claim 1 wherein said metal mesh is made from stainless steel.

3. The method of claim 1 further comprising the step of plating said metal mesh with a metal selected from a group consisting of gold, silver, rhodium and gun metal.

4. The method of claim 1 wherein said strips of material are made from leather.

5. The method of claim 1 further comprising the step of cutting said mesh to a desired size.

6. The method of claim 1 further comprising the step of cutting said mesh to a desired shape.

7. The method of claim 1 further comprising the step of soldering the cut ends of the cables in said metal mesh.

8. The method of claim 1 further comprising the step of covering the cut ends of the cables in said metal mesh by extending said strips of material beyond said mesh and over the cut cables.

* * * * *